US007406887B2

(12) United States Patent
Jensen

(10) Patent No.: US 7,406,887 B2
(45) Date of Patent: Aug. 5, 2008

(54) PUMPING UNIT WITH VARIABLE WORK STROKE AND RETURN STROKE TORQUE FACTOR CHARACTERISTICS

(76) Inventor: James B. Jensen, P.O. Box 1509, Coffeyville, KS (US) 67337

( * ) Notice: Subject to any disclaimer, the term of this patent is extended or adjusted under 35 U.S.C. 154(b) by 721 days.

(21) Appl. No.: 10/947,906

(22) Filed: Sep. 23, 2004

(65) Prior Publication Data

US 2006/0060011 A1 Mar. 23, 2006

(51) Int. Cl.
*F16H 21/32* (2006.01)

(52) U.S. Cl. ..... 74/41; 74/104; 185/33; 417/328; 417/329

(58) Field of Classification Search ..... 185/33; 74/41, 104; 417/328, 329
See application file for complete search history.

(56) References Cited

U.S. PATENT DOCUMENTS

| | | | | | |
|---|---|---|---|---|---|
| 1,986,012 | A | | 1/1935 | Patterson | |
| 2,294,094 | A | | 8/1942 | O'Leary | |
| 2,958,237 | A | * | 11/1960 | Johnson | 74/522 |
| 3,006,201 | A | * | 10/1961 | Ross | 74/41 |
| 3,371,554 | A | | 3/1968 | McCray et al. | |
| 3,406,581 | A | * | 10/1968 | Eyler et al. | 74/41 |
| 3,851,995 | A | * | 12/1974 | Mills | 417/12 |
| 4,501,119 | A | * | 2/1985 | Stanton | 60/398 |
| 4,502,343 | A | | 3/1985 | Dingfelder | |
| 4,505,162 | A | | 3/1985 | Hoh et al. | |
| 4,603,592 | A | | 8/1986 | Siebold et al. | |
| 4,660,426 | A | * | 4/1987 | Mosley | 74/41 |
| 4,996,940 | A | | 3/1991 | Cleary | |
| 5,105,671 | A | | 4/1992 | Slater | |
| 6,386,322 | B1 | * | 5/2002 | McCormick | 185/33 |
| 2006/0060011 | A1 | * | 3/2006 | Jensen | 74/41 |

* cited by examiner

*Primary Examiner*—David M Fenstermacher
(74) *Attorney, Agent, or Firm*—Gable Gotwals

(57) ABSTRACT

A pumping unit system having vertical sampson post, a walking beam pivotally supported at the upper end of the sampson post and a horsehead affixed at a forward end thereof that supports a reciprocated sucker rod string, including a gear reducer mounted at selectable positions on the walking beam and having a horizontally extending drive shaft, a crank arm affixed to the drive shaft the spacing between a selectable length pitman rod having a first end secured to said crank arm and a second end having a pitman bearing that is selectably mountable to a plurality of pitman bearing locations and a prime mover connected to the gear reducer and wherein the characteristics of the pumping unit are determined by the selectable position of the gear reducer, the selectable length of the crank arm, the selectable length of the pitman rod, and the selectable pitman bearing location.

11 Claims, 5 Drawing Sheets

PUMPING UNIT WITH VARIABLE WORK STROKE AND RETURN STROKE TORQUE FACTOR CHARACTERISTICS

REFERENCE TO PENDING APPLICATIONS

This application is not based upon any pending domestic or international patent applications.

REFERENCE TO MICROFICHE APPENDIX

This application is not referenced in any microfiche appendix.

BACKGROUND OF THE INVENTION

1. Field of the Invention

The present invention relates to a pumping unit for actuating a down hole pump for pumping fluid, primarily crude oil, from subterranean oil-bearing formations to the earth's surface. More particularly, the present invention relates to a pumping system that includes a sampson post extending upwardly from a base supported on the earth's surface, a walking beam pivotally supported by a saddle bearing at the sampson post upper end with a horsehead affixed at a forward end of the walking beam to receive the upper end of a downwardly extending sucker rod string by which a subsurface pump is vertically reciprocated, the system including a gear reducer mounted on the walking beam for rotating a crank arm. The crank arm has affixed at the outer end thereof a crank pin bearing which secures one end of a pitman rod, the opposite end of the pitman rod being affixed by a pitman bearing to a variably pitman bearing location relative to the sampson post by which the characteristic of the pumping unit upward work strokes and downward return strokes can be selectably varied.

2. Prior Art

A primary source of energy as used by the world today is derived from crude oil. Oil-bearing formations deep below the earth's surface are the source of crude oil. Bore holes are drilled from the earth's surface downwardly to penetrate crude oil producing formations. In some parts of the world such formations have sufficient formation pressure that crude oil is forced to the earth's surface in which case the crude oil is recovered without being pumped. In other parts of the world formation pressures are insufficient to force the crude oil to the earth's surface and therefor the crude oil must be pumped. In many instances when a formation is initially penetrated the formation pressure causes the crude oil to flow to the earth's surface but after a time as quantities of crude oil are removed from the formation the formation pressure drops so that it then becomes necessary to pump the crude oil to the surface.

Various systems exist for pumping crude oil from a subterranean formation including hydraulic pumping systems, electric pumping systems in which a motor rapidly rotates a centrifugal pump, and so forth. However, the most commonly used system for extracting crude oil from a producing formation is by the use of a reciprocating string of sucker rods that extend within a bore hole from the earth's surface to a positive displacement, reciprocating pump. At the earth's surface a system must be provided for sequentially reciprocating the sucker rods in up and down fashion. The most common mechanism for performing this work is referred to as a pumping unit. The common type of pumping unit includes a base mounted on the earth's surface. Upwardly extending from the base is a post, sometimes referred to as a sampson post. At the top of the sampson post is a saddle bearing that pivotally supports a walking beam. The walking beam has at one end a "horsehead" that receives a wire line or cable that passes over a convex outer face of the horsehead, the outer face being curved with reference to saddle bearing as pivotal axis of the walking beam. The wire line connects at its lower end to the upper end of the string of sucker rods. The sucker rods are vertically reciprocated by the pivotation of the walking beam in a vertical plane.

Various systems have been devised for providing the pivotal action of a walking beam supported on a sampson post to achieve the reciprocal action necessary to move sucker rods to actuate a bottom hole pump. The invention herein relates to such a system.

A typical bottom hole pump includes a piston vertically reciprocating in a cylinder, the piston being connected to the sucker rod string so that as the horsehead of the pumping unit is pivoted the sucker rods move the pump piston in an oscillatory cycle. The upward movement of the sucker rods caused by the pivoting walking beam is usually termed a "work stroke" and downward movement that permits the pump piston to return to the lower part of the pump barrel as referred to as a down or "return stroke."

Various means have been devised for reciprocating the walking beam. Further, it is important that the walking beam be counterbalanced to counteract the huge weight of the string of sucker rods that extend from the earth's surface. The length of a string of sucker rods may vary from a few hundred feet to a few thousand feet and accordingly constitute a substantial weight. Further, as the sucker rod string is moved upwardly, the column of fluid within the well bore hole is simultaneously moved upwardly to elevate the fluid to the earth's surface that constitutes the well's production.

The typical, that is the most common pumping unit, employs a gear reducer mounted on a slab or base that rests on the earth's surface. The gear reducer has a horizontal rotating shaft extending therefrom. A crank arm has one end affixed to the rotating shaft. At the other end of the crank arm is a bearing that receives the first end of a pitman rod. The second or upper end of the pitman rod is affixed to the walking beam. Rotative energy is supplied by a prime mover to the gear reducer to rotate the crank arm and thereby oscillate the pitman rod to cause the pumping unit walking beam to pivotally reciprocate in a vertical plane.

This typical type of pumping unit requires substantial counterbalancing. For this reason, weights are affixed to the walking beam to help offset the weight of the sucker rod string plus the weight of fluid being lifted. Many pumping units in use today include dynamic counterbalance weights that rotate with the crank arm. Properly designing and operating a pumping unit, particularly for a deep well, is an exacting science.

A complicating factor with respect to a pumping unit design is caused by the elasticity of the sucker rod string. That is, as the pumping unit pivots to lift the sucker rod string and accordingly the weight of the column of fluid in the well bore hole, the sucker rods stretch due to the elasticity of the steel or other metal alloys of which the sucker rods are constructed. When the sucker rods are in the downward or return stroke mode the sucker rods contract. The extension and contraction of a sucker rod string can introduce complex standing wave phenomena that must be taken into consideration in the design and operation of pumping units, especially for deeper wells.

Much creative work has been done in designing pumping units. The American Petroleum Institute has published works relating to the design and operation of pumping units entitled, "*API Specification For Pumping Units, American Petroleum*

*Institute, Washington D.C.*" and issued by the American Petroleum Institute Production Department, 211 N. Irvay, Suite 1700, Dallas, Tex. 75201. This document was published in 1984 and is a standard reference for those engaged in designing and operating pumping units.

For reference to prior issued United States patents that provide a good background relating to the subject matter of pumping units and therefore specifically relating to the subject of this invention, reference may be had to the following previously-issued United States patents:

| U.S. Pat. No. | Inventor | Title | Issue Date |
|---|---|---|---|
| 4,660,426 | Mosley | PUMPING UNIT FOR ACTUATING A DOWN HOLE PUMP WITH STATIC AND DYNAMIC COUNTERWEIGHTS | Apr. 28, 1987 |
| 1,986,012 | Patterson | PUMP ACTUATING MECHANISM | Jan. 1, 1935 |
| 4,603,592 | Siebold et al | OFF-VERTICAL PUMPING UNIT | Aug. 5, 1986 |
| 2,958,237 | Johnson | STROKE ADJUSTING MECHANISM | Nov. 1, 1960 |
| 4,505,162 | Hoh et al | OIL WELL PUMPING APPARATUS AND METHOD | Mar. 19, 1985 |
| 5,105,671 | Slater | WELL PUMPING UNIT WITH ADJUSTABLE BALANCE BEAM | Apr. 21, 1992 |
| 4,502,343 | Dingfelder | PUMP JACK | Mar. 5, 1985 |
| 3,371,554 | McCray et al | INTEGRAL CRANK AND PHASED COUNTERWEIGHT ARM | Mar. 5, 1968 |
| 2,294,094 | O'Leary | COUNTERBALANCED PITMAN GEARING | Aug. 25, 1942 |

BRIEF SUMMARY OF THE INVENTION

The invention herein is a pumping unit having a base supported on the earth's surface. A sampson post structure extends upwardly from the base. A walking beam is pivotally supported by a saddle bearing at the top of the sampson post. A horsehead is affixed at a forward end of the walking beam that is adapted to support the upper end of a downwardly extending sucker rod string by which a bottom hole pump positioned in a well bore hole can be reciprocated. In this way crude oil can be pumped from a deep subterranean formation to the earth's surface.

A gear reducer is mounted on the walking beam, the gear reducer having a horizontally extending output drive shaft.

A crank arm has an inner end affixed to the gear reducer output drive shaft by which the crank arm is rotated in a vertical plane. A crank arm bearing is affixed adjacent the outer end of the crank arm. The distance between the drive shaft axis and the crank arm bearing is called the "crank throw."

A pitman rod has an upper end secured to the crank arm bearing. A lower end of the pitman rod is selectably attachable at a plurality of stationary anchor points either on the pumping unit base or the Sampson post structure. Each anchor point provides a different pumping action.

A prime mover is provided for supplying energy input to the gear reducer for the rotation of the output shaft. The prime mover is typically an electric motor secured to the walking beam. When a source of electrical energy is not readily available an alternative arrangement is to provide a gas or gasoline powered generator that can be mounted on or adjacent the pumping unit base with conductors extending to an electric motor supported on the walking beam. The pumping unit provides sequential pumping cycles, each cycle including an upward work stroke and a downward return stroke. Rotational cycles of the crank arm provide coordinated movement of the walking beam.

A unique feature of the invention herein is a pumping unit in which the angular rotation of the crank arm is selectably variably coordinated with pivotation of the walking beam so that the characteristics of the pumping cycle is selectable according to whether the walking beam pivotation adds or subtracts from the rotation of the crank arm during upward work strokes.

Another unique feature of the invention herein is a pumping unit in which the pitman rod bearing is selectably positionable in location to adjustably vary the acceleration of the walking beam during upward power strokes compared to downward return strokes.

The ability to selectably vary these characteristics occurring in the pumping cycle enables a manufacturer to design a pumping unit in which stress on the pumping unit for a given depth well is significantly reduced compared to a standard pumping unit on the market today. Further, counterbalancing is always required of the walking beam. The typical counterbalance includes weights placed on the walking beam at the end thereof that is opposite the horsehead to offset the weight of the sucker rod string plus the weight of a column of a fluid as it is being lifted during the pump stroke. By supporting the gear reducer on the walking beam the amount of counterbalance weight is significantly reduced. In addition, by being able to selectably adjust the pumping unit characteristics the peak stress loads typically encountered are significantly minimized thereby permitting the overall structure of the pumping unit be significantly reduced.

The pumping unit of this disclosure is unique in having pumping characteristics that are determined by the combination of: (1) the selectable position of the gear reducer relative to the saddle bearing; (2) the selectable throw of the crank arm; (3) the selectable length of the pitman rod; and (4) the selectable pitman bearing location.

A better understanding of the invention will be obtained from the following detailed description of the preferred embodiments taken in conjunction with the claims and the drawings attached hereto.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

DETAILED DESCRIPTION OF THE PREFERRED EMBODIMENTS

Elements shown by the drawings are identified by the following numbers:

| | |
|---|---|
| 10 | pumping unit |
| 12 | earth's surface |
| 14 | base |
| 16 | sampson post structure |
| 18 | pivot bearing |
| 20 | walking beam |
| 22 | horsehead |
| 24 | forward face |
| 26 | sucker rod sling |
| 28 | sucker rod string |
| 30 | well head |
| 32 | production pipe |
| 32 | counterweight |
| 34 | positioning mechanism |
| 36 | gear reducer |
| 38 | drive shaft |
| 40 | A–D crank arm |
| 42 | crank pin bearing |
| 44 | pitman rod |
| 46A-D | pivot bearing |
| 48A-B | pitman rod support structure |
| 50 | drive wheel |
| 52 | electric motor |
| 54 | belts |
| 56 | standard torque curve |
| 58 | torque curve this invention |
| 60 | RMS level standard unit |
| 62 | RMS level—this invention |
| 64 | average torque—standard unit |
| 66 | average torque—this invention |

Figure 1:
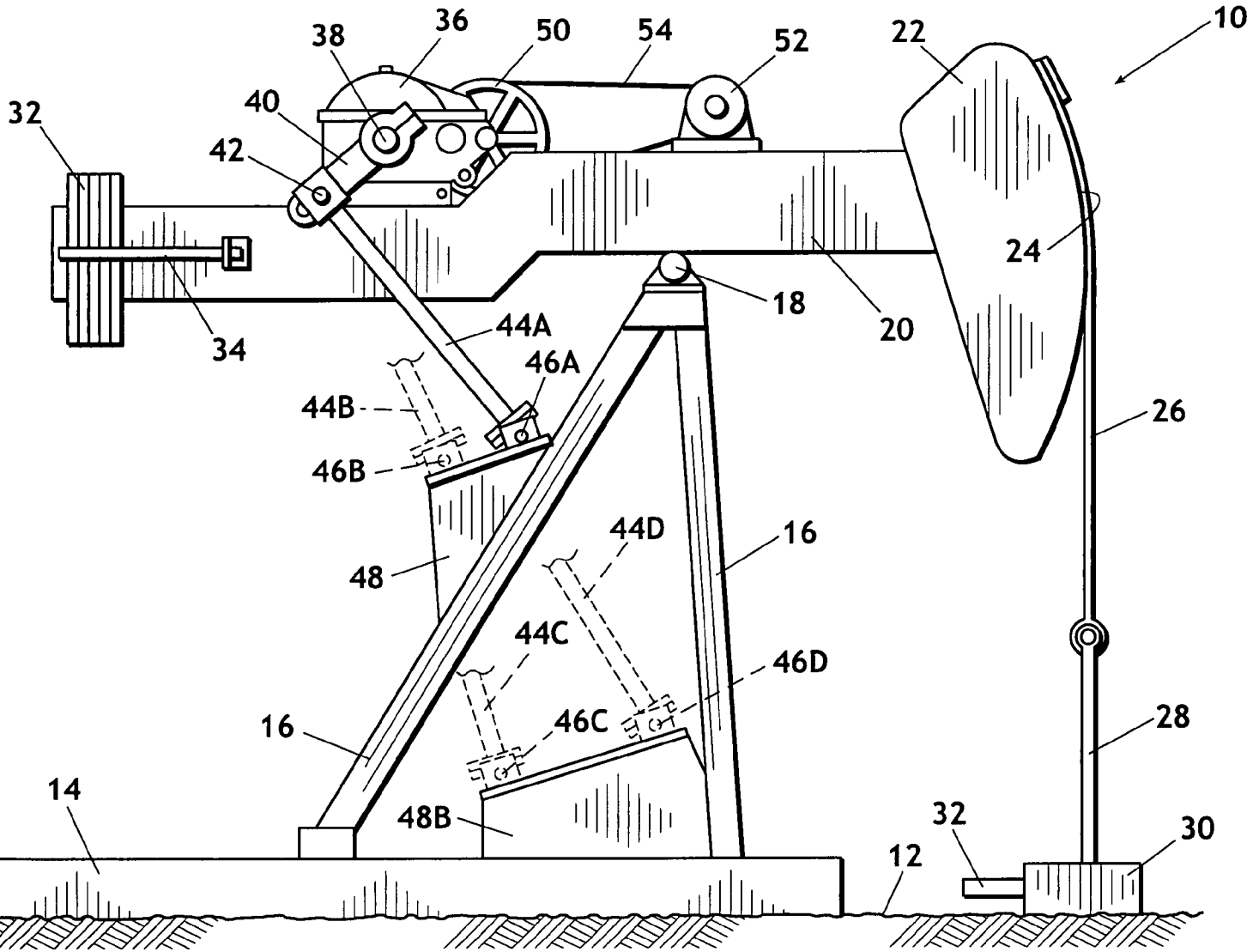
FIG. 1 is an elevational view of a pumping unit that illustrates the principles of this invention. The pumping unit as shown includes a sampson post structure extending vertically upwardly from a pumping unit base that rests on the earth's surface. Pivotally supported at the top of the sampson post structure by a saddle bearing is a walking beam having, at the forward end a horsehead that supports a string of sucker rods extending downwardly in a bore hole in the earth. At the rearward end of the walking beam is a counterweight. Positioned on the walking beam is a gear reducer having a crank shaft rotatably extending therefrom. Affixed to the crank shaft is a crank arm. Affixed to the crank arm by a crank arm bearing is one end of a pitman rod, the opposite end being selectably connectable by a pitman bearing to a fixed point on to the sampson post structure or on the pumping unit base.

Referring to FIG. 1, a pumping unit representing this invention is generally indicated by the numeral 10, the pumping unit being shown supported on the earth's surface 12. A base 14 that rests on the earth's surface 12 supports an upwardly extending sampson post structure 16 that is typically formed of steel angular components as illustrated. Affixed to the upper end of sampson post 16 is a saddle bearing 18 that pivotally supports a walking beam 20. Affixed at a forward end of walking beam 20 is a horsehead 22 having an arcuate forward face 24 that is semicircular about saddle bearing 18. Secured to the horsehead 22 and on forward face 24 is a sucker rod sling 26 formed of cable. Secured to the lower end of the sucker rod sling is a string of sucker rods 28 that extend downwardly within a bore hole (not seen) in the earth and that connects to a piston of a positive displacement bottom hole pump (not seen). Sucker rod string 28 typically starts with a polished rod that extends through a stuffing box in a well head 30. Reciprocation of the sucker rod string 28 raises a column of fluid in the bore hole to the earth's surface, the produced fluid passing out of the well head 30 through a production pipe 32, the produced fluid being typically crude oil. The crude oil through the production pipe 32 to a pipeline or collection tank (not seen) by which the produced crude oil is finally conveyed to a refinery for use in manufacturing finished petroleum products including gasoline, diesel fuel, jet fuel, lubricating oil, etc.

Affixed adjacent the rearward end of walking beam 20 is a counterweight 32 that is used to, at least in part, offset the weight of the sucker rod string 28 and the column of fluid as it is lifted to the earth's surface. A positioning mechanism 34 is illustrative of systems by which the exact position of counterweight 32 on walking beam 20 can be adjusted.

All of the elements enumerated to this point are found in a typical walking beam type pumping unit employed for vertical reciprocation of sucker rods in a well bore hole, and no uniqueness is claimed as to any of these features. Instead, this invention is concerned with the mechanisms employed to pivot walking beam 20 in a manner that takes maximum advantage of proper timing of the characteristics of movement of the sucker rod string 28 during upward power strokes and downward return strokes of the pumping cycle to thereby provide a pumping system that employs less energy to operate and with reduced structural requirements.

Mounted on walking beam 20 is a gear reducer 36 having a horizontal drive shaft 38 extending therefrom. Affixed to drive shaft 38 is a crank arm 40. As drive shaft 38 rotates crank arm 40 is rotated in a vertical circle around the drive shaft in a continuous manner.

A crank arm bearing 42 is secured to crank arm 40. Provision is made for selectably moving crank arm bearing 42 with respect to drive shaft 38 to thereby vary the crank arm throw. That is crank arm bearing 42 may be moved farther away from drive shaft 38 to increase the throw of the crank arm or moved closer to drive shaft 38 to reduce the throw.

A pitman rod 44A has a first or upper end pivotally attached to crank arm bearing 42. The outer or second end of pitman rod 44 is secured to a pitman bearing 46 that is fixed with respect to the sampson post structure 16. An important concept of this invention is that the location of the pivot bearing 46 is selectably adjustable since, as will be pointed out subsequently, the location of pivot bearing 46 with respect to the pumping unit structure is one of the features that is critical in the unique operation of the pumping unit of this invention. For this reason, a variety of locations of pitman bearing 46 are shown. Illustrated are pivot bearing locations 46A, 46B, 46C, and 46D.

In addition to the selectability of the pivot bearing locations that support the outer or second end of pitman rod 44 that can be employed to change the characteristics of the pumping unit, another and companion feature is that the pumping unit has selectably variable pitman rod lengths. As an example, pitman rod 44A has a relatively short length as it extends from crank arm bearing 42 to pitman bearing 46A. Pitman bearing 46B is shown at an alternate location with pitman rod 44B of the same length as pitman rod 44A. Longer length pitman rods are illustrated in dotted outline and identified by the numeral 44C that extends to pitman bearing 46C and pitman rod 44D that extends to pitman bearing 46D.

In the design of a pumping unit to incorporate the principles of this invention a pitman rod support structure 48 may be fabricated to attach directly to the sampson post structure 16. That structure will typically be formed of structural steel components and of welded or bolted construction. Alternatively, a pitman rod support structure 48B is shown as affixed to base 14. If the base 14 is of reinforced poured concrete then pitman rod support structure 48B can in like manner be formed of reinforced poured concrete that is poured as a part of the base 14. Alternatively, the pitman rod support structure 48B can be a fabricated steel structure that is mounted to base 14 or mounted partially to base 14 and partially to the sampson post structure 16.

The provision of selectable mounting points for pitman bearing 46A-46D and the selectable length of the pitman rod is illustrated in 44A-44D is, as previously indicated, an important aspect of the invention and provides a pumping unit that achieves results that have not heretofore been obtained employing pumping units of known configurations.

Gear reducer 36 has a drive wheel 50 by which power is supplied to it. A gearing system (not shown) within the gear reducer 36 translates the rotary energy supplied to drive wheel 50 to rotate drive shaft 38 typically at a substantially reduced rpm.

To supply energy to gear reducer 36 a prime mover is employed. This can be and preferably is an electric motor 52 mounted on walking beam 20 that drives belts 54 by which energy is supplied to gear reducer 36.

When electrical energy is not readily available at a location where the pumping unit 10 is to be employed the system can nevertheless be easily utilized by providing a gas or gasoline powered generator (not shown) mounted on or adjacent base 14 with an electric cable extending to electric motor 52. It would theoretically be possible to mount a gas or gasoline internal combustion engine in place of the electric motor 52 on the pumping unit 10 however servicing of an internal combustion engine at such elevated position on the pumping unit and the constant motion of the walking beam introduces complicating factors, so as a practical matter, the system of this invention is best employed by use of an electric motor 52 as illustrated.

Figure 2:
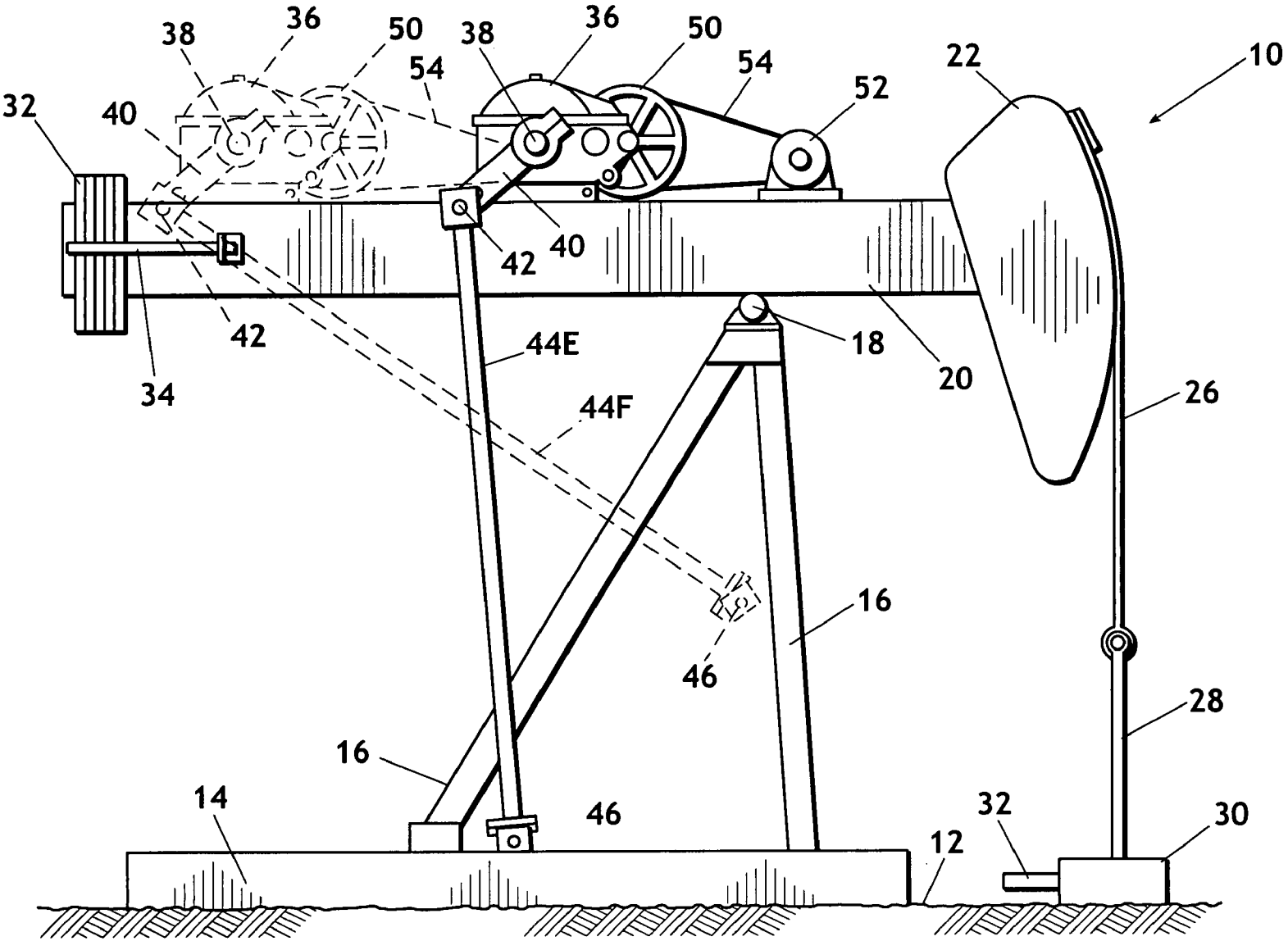
FIG. 2 is an elevational view of a pumping unit as in FIG. 1 but showing the gear reducer being selectably positionable on the walking beam and the pitman bearing being selectably positionable.

FIG. 2 illustrates the maximum advantage of acceleration and torque factors in solid line. Minimum advantage of acceleration and torque factors are illustrated in the phantom line layout. The variables in this view are: (1) gear reducer 36 location and (2) pitman bearing 46 location. The crank arm 40 length and pitman 44 length do not change.

Figure 3:
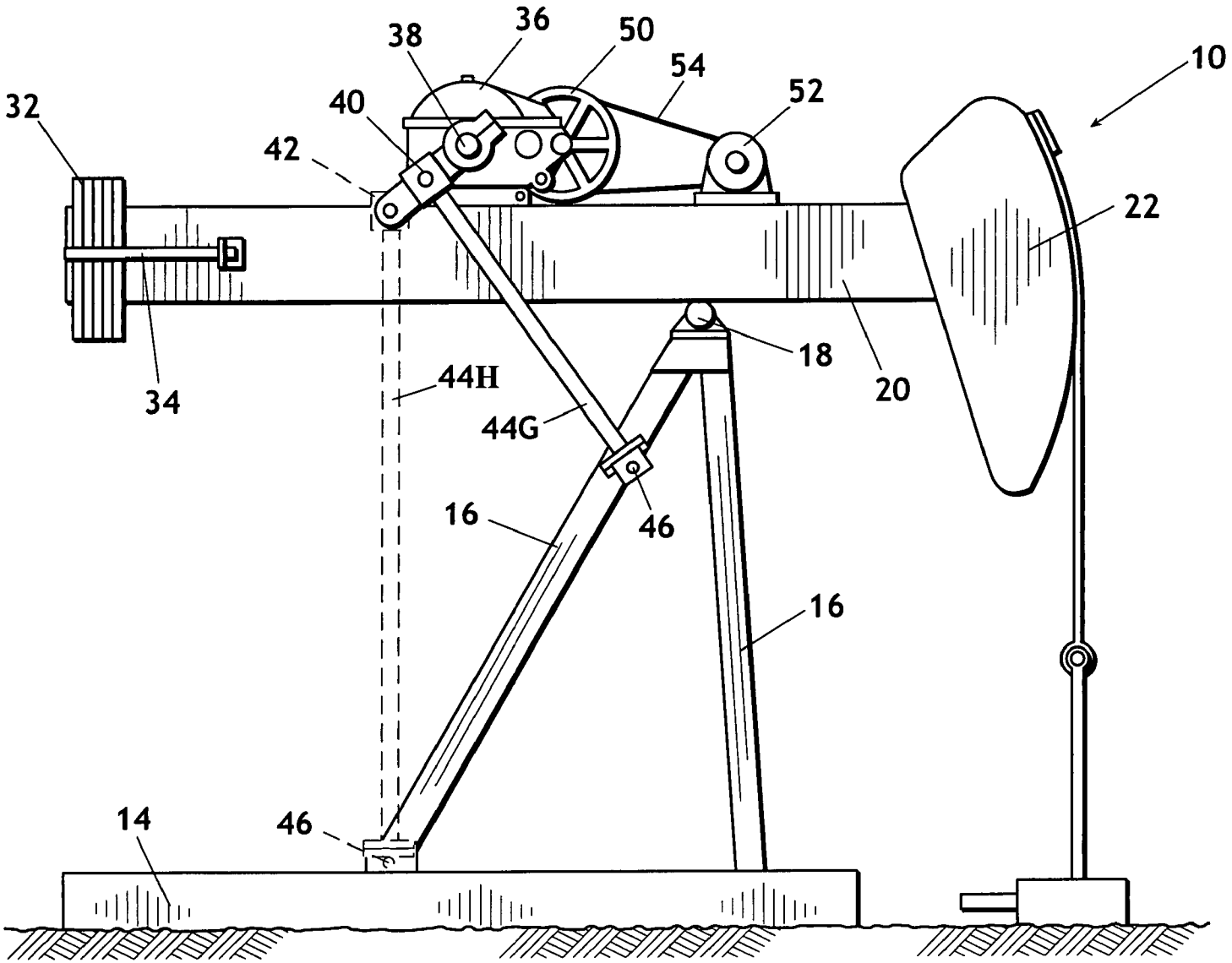
FIG. 3 is an elevational view of a pumping unit as in FIG. 2 but showing the crank arm throw being adjustable, the length of the pitman arm being adjustable and the pitman bearing being selectably positionable.

FIG. 3 illustrates the maximum advantages of acceleration and torque factors obtained in the phantom line layout. Minimum advantage of acceleration and torque factors are illustrated in the solid line layout. The variables in this view are: (1) pitman bearing 46 location; (2) pitman 44 length, and (3) crank arm 40 length (crank throw). The gear reducer location is not changed.

Figure 4:
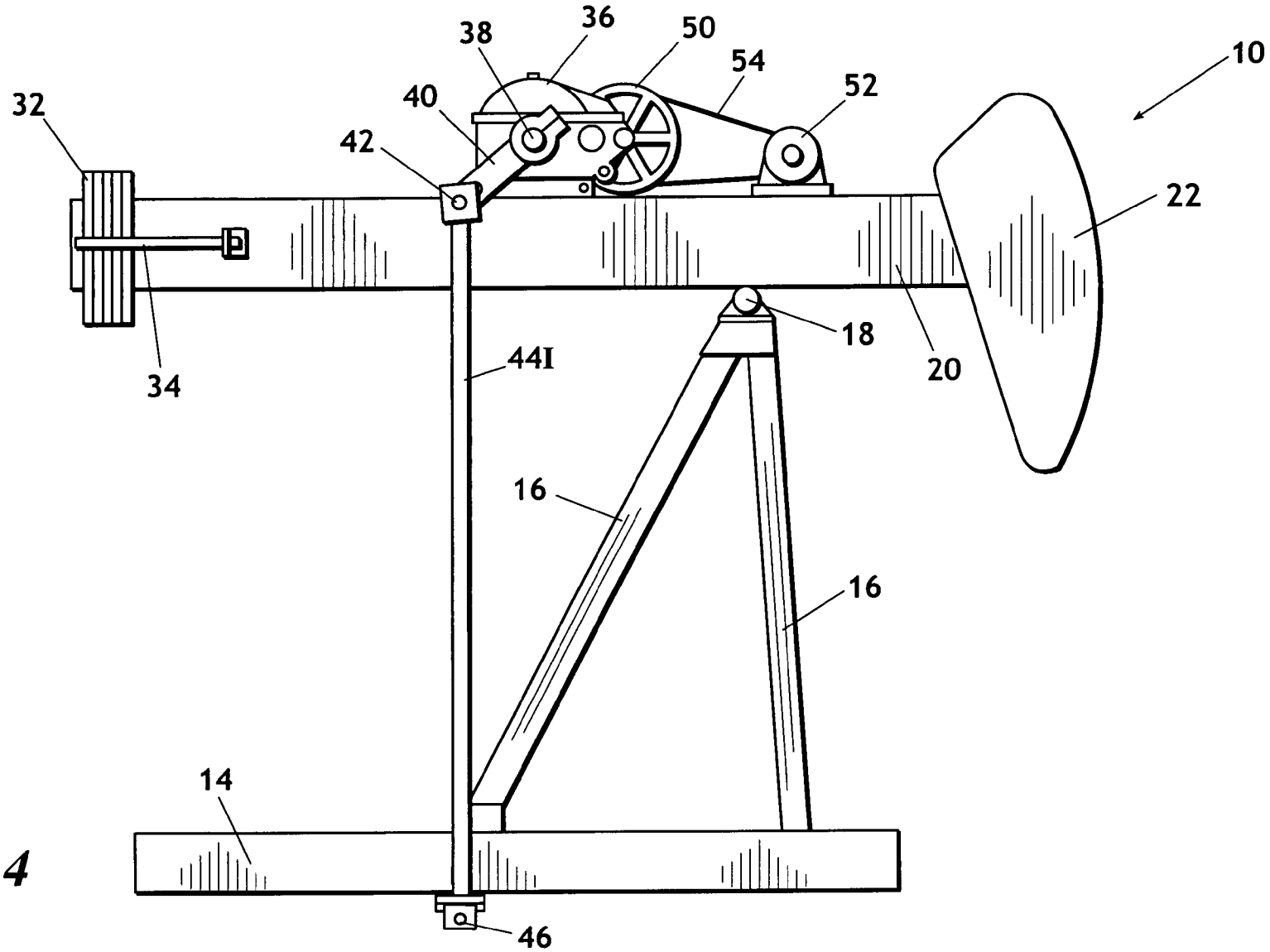
FIG. 4 is an elevational view of a pumping unit as in FIGS. 2 and 3 but showing the pumping unit configured for maximum advantages of acceleration and torque factors.

FIG. 4 illustrates the maximum advantage of acceleration and torque factors obtained from the geometry of the pumping unit. To keep the stroke length the same in this embodiment requires: (1) maximum length of pitman 44, (2) maximum length of crank arm 44 (crank throw), (3) gear reducer 36 located as near to the saddle bearing 18, and (4) the pitman bearing 46 location must be adjustable since the other three factors will force changes in the pitman bearing 46 location.

The pumping unit of this invention uniquely provides the combinations of the following four variables to control acceleration and torque factors: (1) gear reducer 36 location; (2) crank throw 40; (3) pitman 44 length, and (4) pitman bearing 46 location.

Variations in well characteristics from Dynalog graphs demonstrate the effects of acceleration. The pumping unit of this invention improves these conditions by making it possible to adjust acceleration patterns. The size of counterbalance 32 is improved through adjustments of the torque factor pattern. The result of these improvements make possible the use of smaller gear reducers 36, prime movers 52, and counterbalances 32 and result in lower operating expenses by lowering power requirements.

The reciprocating movement of the sucker rods created by the pumping unit gives additions or subtractions to the well load through laws of momentum and inertia. On the up stroke the acceleration loads add and on the down stroke the acceleration loads subtract. By the selection of the pitman bearing attachment point and the angular relationships of the crank arm 40 compared to the angle of pivotation of walking beam 20 maximum torque factors can be minimized.

The acceleration factor can be visualized by observing the angle of the pitman 44 movement relative to the angle of the walking beam 20 movement. The torque applied to gear reducer 36 is lowered when acceleration reduces the well load. This means that a smaller gear reducer 36 and a smaller prime mover 52 are required for the same sucker rod loads.

Torque factor pattern adjustments can be made to achieve a substantial reduction in the counterbalance requirements. Lowering torque factors on the up stroke and raising torque factor on the down stroke timed with the heavy load on the upstroke and a light load on the down stroke lowers counterbalance requirements.

As the angle of walking beam 20 changes it adds or subtracts from the rotation of crank arm 40 by the rotation of gear reducer 36, making the reducer function at a higher or lower ratio. Changes in spacing between the crank pin bearing 42 and the pivot bearing 18 creates a variable length linkage to walking beam 20 and therefore raises or lowers the torque factor.

Figure 5:
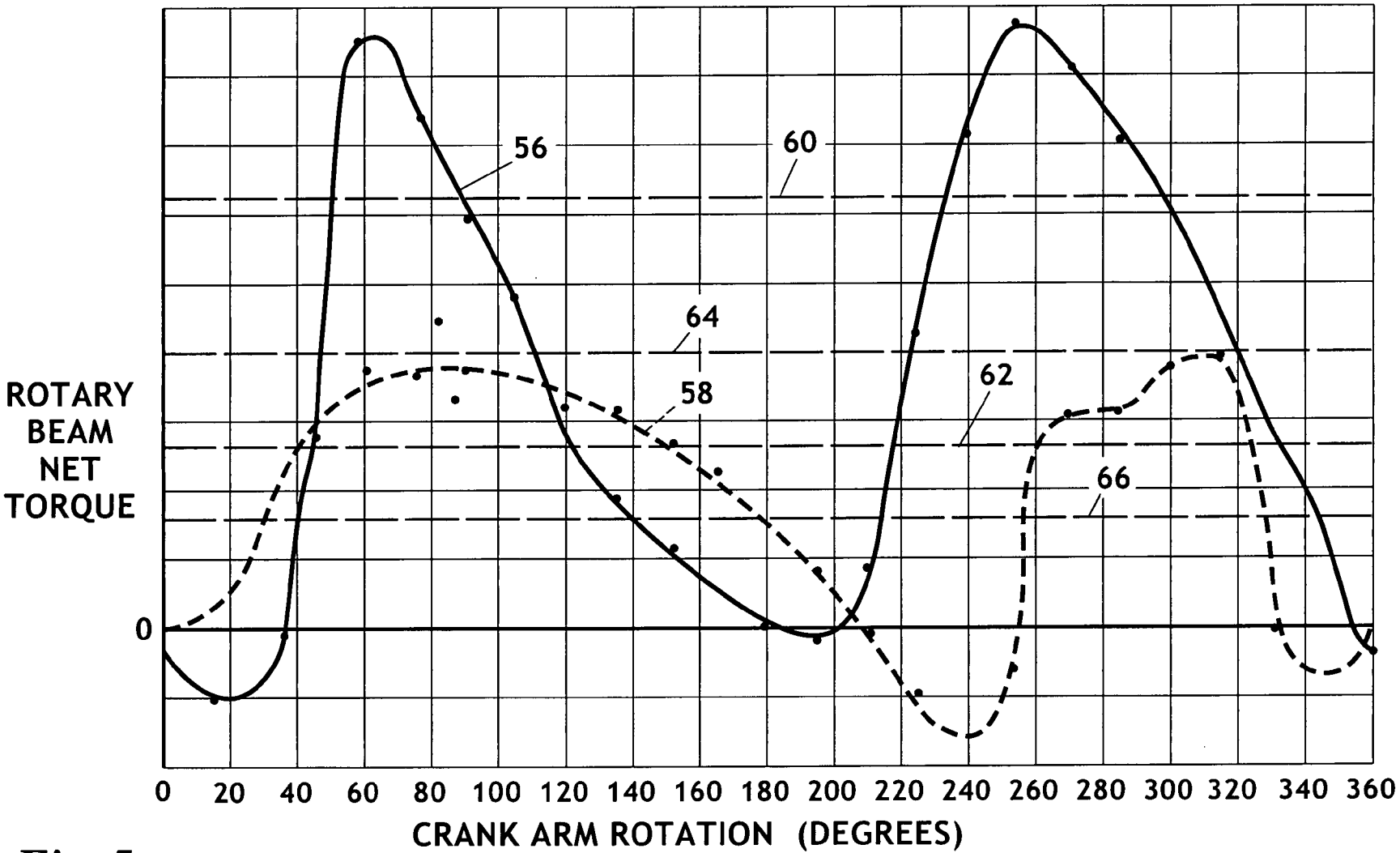
FIG. 5 is a graph showing the relative net torque applied during 360°, that is a full rotation of the crank arm. In solid line the torque encountered with the typical pumping unit on the market today is shown. The dotted line shows the reduced torque peaks as accomplished with the pumping unit of this invention.

FIG. 5 is a graph showing torque values as the crank arm 40 of pumping unit 10 rotates through a 360°. In this chart the abscissa shows a crank arm rotation in degrees while the ordinate shows the torque applied to drive shaft 38 of gear reducer 36 at various stages in the crank arm rotation. No units are illustrated for the torque along the ordinate but such units are typically stated in inch-pounds of torque. Actual units are not given in the chart of FIG. 4 since the purpose of the chart is not to illustrate actual measured torque but to illustrate a comparison of representative torque encountered in different types of pumping units. FIG. 56 illustrates a curve for a typical pumping unit having the prime mover and gear reducer mounted stationarily on a pumping unit base is indicated by the numeral 56. Note that in the standard torque curve 56 that torque is exceedingly high between different portions of the pumping cycle. The portion between 0 and 180° of crank arm rotation is indicative of the upstroke or lift stroke of a pumping unit that is seen at its peak in FIG. 3 whereas the second half of the chart between 180° and the 360° of crank arm rotation shows that torque peak again in response to the force required to lift the counterweight that are commonly employed on the rearward end of the walking beam of a standard pumping unit. Torque curve 56 thus illustrates the wide swings of the torque requirements meaning that the gear reducer and prime mover of the standard pumping unit must be of large size sufficient to provide these high torque requirements.

In contrast, a torque requirement of the pumping unit of this invention as illustrated in FIGS. 1 through 4 wherein the gear reducer 32 is mounted on walking beam 20 is exemplified by torque curve 58. Note the contrast between the standard torque curve 56 and the torque curve 58 of the pumping unit of the present invention and particularly note that the peak torque requirements during a 360° crank arm rotation are substantially reduced employing the principles of the pumping unit illustrated herein.

The root means square or RMS of the standard pumping unit is illustrated by the level 60 while the RMS of the pumping unit of FIGS. 1 through 4 of the present invention is indicated by the level 62. Another comparison is the average torque of the standard pumping unit is illustrated by the number 64 whereas the average torque of the pumping unit of this invention is indicated by the level 66.

The significant reductions in torque including specifically the peak torque requirements of the standard pumping unit compared to the present pumping unit and the average torque requirements of the standard pumping unit compared to the present pumping unit serve to illustrate the great advantages of the pumping unit as illustrated herein. Further, these comparisons indicate that a pumping unit employing the principles of this invention can be substantially smaller in its mechanical structural requirements and therefore of substantially reduced manufacturing costs compared to the standard pumping unit.

It can be seen that in the pumping unit of this invention the rotation of the crank arm 40 along with the rotation (pivotation) of walking beam 20 gives a variable motion according to whether the walking beam rotation adds to or subtracts from the rotation of crank arm. By selectably positioning pitman bearing 46 and varying the length of pitman rod 44, the addition or subtraction of the walking beam rotation relative to the crank arm rotation can be selectively synchronized. This action creates a net torque curve that is substantially flatter than the torque curve of the standard pumping unit. A preferred operation of the pumping unit of the present invention is to arrange highest acceleration at the beginning of the up stroke and the ending of the down stroke of the pumping unit.

Torque factor is a method used to anticipate the peak torque experienced by gear reducer 36. The torque factor for the standard pumping unit is found by the application of the well load and forces applied through the pitman rod to the crank arm and the walking beam. In this standard pumping unit, the torque factor are substantially equal in the up and down strokes since the gear reducer does not move. The torque factor for the pumping unit of the present invention is calculated in the same way as for the standard pumping unit except that in the present invention the walking beam ratio is changing because of the center of rotation of the crank is moving and the gear reducer ratio is changing. The reduced net torque achieved by the present invention as illustrated by torque curve 58 of FIG. 5 is obtained because the crank arm and beam ratio are adding or subtracting. The torque factor is decreased on the up stroke and increased on the down stroke and are therefore not equal as occurs in the standard pumping unit.

By the acceleration applied during rod loading and the out of sync aspects compared to the torque factor of the present pumping unit result in a drastic reduction in peak torque and a substantial reduction in the prime mover torque thereby permitting these components to be reduced in size to achieve the same pumping results. Further, the accomplishment of variable torque factor up from down reduces counterbalance requirements. The total counterbalance required, such as counterbalance 32 in FIG. 1, can be reduced significantly.

The improved pumping unit of this invention is designed to change acceleration and torque factors to match well conditions. This is important since wells are not the same as each well varies in sucker rod load, fluid load, rod stretch, quantity of fluid production, etc.

The pumping unit herein provides variation in the sucker rod acceleration. A long pitman rod such as 44C and 44D as seen in FIG. 1 results in increased acceleration whereas a short pitman rod such as 44A and 44B in FIG. 1 or 44G of FIG. 3 result is minimum acceleration.

In summary, the pumping unit as illustrated and described herein provides control for taking full advantage of acceleration and torque factors. Further, the position of gear reducer 36 on walking beam 20 can be selectably varied which provides additional adjustment to tune the pumping unit to fit particular well conditions.

It is understood that the invention has been illustrated and described herein with reference to specific embodiments. However the invention is not limited to these embodiments illustrated for purposes of exemplification. Instead the invention is to be limited only by the scope of the attached claim or claims including the full range of equivalency to which each element thereof is entitled.

What is claimed is:

1. A pumping unit for actuating a down hole pump including a post extending upwardly from the earth's surface, a walking beam connected at a saddle bearing pivot point to the post, said pumping unit having a pumping cycle including successive upward work strokes and downward return strokes at a forward end of said walking beam forming a pump stroke length, comprising:

a gear reducer mounted on said walking beam at a location displaced from said saddle bearing pivot point and having a drive shaft extending therefrom;

a crank arm rotatably mounted at one end to said drive shaft;

a pitman rod rotatably connected at a first end to said crank arm;

a rearward end of said walking beam having fixedly mounted thereon a counterweight, said crank arm being mounted for unidirectional rotational movement about an axis intermediate said pivot point and said counterweight, said forward end of said walking beam being operably connected to said pump by sucker rods substantially counterbalanced by said counterweight and said gearbox, a second end of said pitman rod having a selectable pitman rod bearing support position relative to said post by which the relationship of said upward work stroke and said downward return strokes of said walking beam can be adjustably selected; and a prime mover connected to supply power to said gear reducer.

2. A pumping unit according to claim 1 wherein said pitman rod bearing support is selectably attachable to said post.

3. A pumping unit according to claim 1 in which said post extends upwardly from a base supported on the earth's surface and wherein said pitman rod bearing support is selectably attachable to said base.

4. A pumping unit according to claim 1 in which said pitman rod is of selectably variable length that can be employed in combination with said selectably pitman rod bearing support to adjust the torque applied by said gear reducer drive shaft during upward work strokes compared to downward return strokes.

5. A pumping unit according to claim 4 wherein said crank arm is of selectable effective length from the point of pivotation to the point of attachment of said pitman rod first end wherein the effective lengths of said crank arm and said pitman rod may be cooperatively varied to obtain a desired pump stroke length.

6. A pumping unit according to claim 1 in which the angular rotation of said crank arm is selectably variably coordinated with pivotation of said walking beam whereby the characteristics of said pumping cycle is selectable according to whether the walking beam pivotation adds or subtracts from the rotation of said crank arm during upward work strokes.

7. A pumping unit according to claim 6 in which whether the walking beam pivotation adds or subtracts from the rotation of said crank arm is determinable by said selectable pitman rod bearing support position.

8. A pumping unit according to claim 6 in which whether the walking beam pivotation adds or subtracts from the rotation of said crank arm during upward work strokes is selectably determined, at least in part, by the length of said pitman rod.

9. A pumping unit for actuating a down hole pump including a walking beam pivotally connected to a post at approximately a midpoint thereof by a saddle bearing, said post fixedly secured to a base mounted on the earth's surface, said pumping unit having a sequential pumping cycles including an upward work strokes and downward return strokes, comprising:

a prime mover connected to supply power to a gear reducer mounted on said walking beam for rotating a drive shaft extending therefrom, a crank arm connected at one end to the drive shaft, said crank arm being interconnected to one end of a pitman rod for oscillating said walking beam in said pumping cycles, a rearward end of said walking beam having mounted thereon a counterweight that combined with the weight of said gear reducer, at least in part, balances the load of sucker rods connected to a forward end of said walking beam, said sucker rods operably connected to a subsurface pump, rotational cycles of said crank arm providing coordinated movement of said pumping cycles, said crank arm unidirectionally rotating relative to said walking beam through a maximum lever arm distance from the center bearing pivotal connection between said walking beam and said post as said forward end of said walking beam moves in work strokes upwardly lifting said sucker rods, said crank arm unidirectionally rotating relative to said walking beam through a minimum lever arm distance from the center bearing pivotal connection between said walking beam and said post as said forward end of said walking beam moves downwardly in return strokes lowering said sucker rods, a second end of said pitman rod being selectably connectable with respect to said post by which torque applied by said drive shaft during said upward work strokes compared with the acceleration during said return strokes is adjustably selectable.

10. A pumping system unit having a base supported with respect to the earth's surface, a sampson post structure extending upwardly from the base, a walking beam pivotally supported by a saddle bearing at the upper end of the sampson post and a horsehead affixed at a forward end of the walking beam adapted to support the upper end of a downwardly extending sucker rod string by which the string is vertically reciprocated, the system including:

a gear reducer mounted at selectable positions relative to said saddle bearing on said walking beam having a horizontally extending output drive shaft having an axis of rotation with respect to the walking beam;

a crank arm having an inner end affixed to said output drive shaft and a crank pin bearing adjacent an outer end thereof, the crank throw achieved by the spacing between said crank arm and said crank pin bearing being adjustable;

a selectable length pitman rod having a first end secured to said crank arm crank pin bearing and a second end having a pitman bearing that is selectably mountable to a plurality of pitman bearing locations relative to said base and sampson post structure; and a prime mover for supplying energy input to said gear reducer for the rotation of said output shaft and wherein the pumping characteristics of the pumping unit are determinable by the combination of (1) the selectable position of said gear reducer relative to said saddle bearing, (2) the selectable crank throw of said crank arm, (3) the selectable length of said pitman rod, and (4) the selectable pitman bearing location.

11. A pumping unit according to claim 10 in which the length of said pitman rod may be varied to provide a third cooperative factor determining said pump stroke length.

* * * * *